US005863451A

United States Patent [19]

Buhler

[11] Patent Number: 5,863,451

[45] Date of Patent: Jan. 26, 1999

[54] SNOW DOME CONSTRUCTION

[75] Inventor: Randall W. Buhler, St. Germain, Canada

[73] Assignee: Norquest Innovation Corporation, Winnipeg, Canada

[21] Appl. No.: 876,366

[22] Filed: Jun. 19, 1997

Related U.S. Application Data

[63] Continuation-in-part of Ser. No. 589,208, Jan. 22, 1996, which is a continuation of Ser. No. 230,818, Apr. 21, 1994, abandoned.

[51] Int. Cl.[6] ..... B28B 7/22

[52] U.S. Cl. ..... 249/13; 249/160; 249/163; 249/164; 249/168; 264/154; 264/219; 264/313; 264/316; 52/2.24; 52/63; 52/745.07; 52/80.2

[58] Field of Search ..... 249/13, 160, 163, 249/164, 168; 264/154, 219, 313, 316; 52/63, 2.24, 745.07, 80.2

[56] References Cited

U.S. PATENT DOCUMENTS

| | | | |
|---|---|---|---|
| 2,731,055 | 1/1956 | Smith | 52/2.24 |
| 3,235,645 | 2/1966 | Thoeny | 264/316 |
| 3,300,823 | 1/1967 | Tuttle | 249/164 |
| 3,857,209 | 12/1974 | Milliken | 52/2.24 X |
| 3,924,363 | 12/1975 | Candle | 52/2.24 X |
| 5,050,354 | 9/1991 | Vendramini | 52/80.1 |
| 5,341,610 | 8/1994 | Moss | 52/80.1 |

*Primary Examiner*—Christopher Kent
*Assistant Examiner*—Yvonne Horton-Richardson
*Attorney, Agent, or Firm*—Murray E. Thrift; Adrian D. Battison

[57] ABSTRACT

A method is provided for constructing a snow shelter. A set of fabric panels is connected together to provide a short skirt into which snow is filled throughout and compacted on the periphery. Panels are then connected to a higher level and additional snow is filled in throughout and compacted on the periphery. When the panels have been completely connected and filled with snow, they encompass a snow dome packed around the surface. The panels may then be removed and the dome hollowed out to provide a snow shelter. The hollowing out process may be guided through the use of probes that are pressed into the dome from the outside to provide a depth gauge. A closeable door may also be installed against the dome opening after the dome is constructed.

8 Claims, 12 Drawing Sheets

SNOW DOME CONSTRUCTION

CROSS REFERENCE TO RELATED APPLICATIONS

This application is a contiuation in part of application Ser. No. 08/589,208, filed Jan. 22, 1996, which is a continuation of application Ser. No. 08/230,818, filed Apr. 21, 1994, now abandoned.

FIELD OF THE INVENTION

The present invention relates to snow shelters and more particularly to a novel method for making snow shelters.

BACKGROUND

Background information that must be understood before the significance of the present invention can be appreciated includes certain characteristic properties of snow, the nature of known snow shelters, and the usefulness of snow shelters. Understanding of these matters is required to appreciate the obstacles to snow shelter construction in a cold, dry snow environment that the present invention addresses.

A. THE EFFECT OF TEMPERATURE ON SNOW

Many large geographical areas have relatively moderate winter climates where, when snow falls, it is usually wet, slushy or damp. This snow, due to it's relatively warm temperature (near the freezing point) is easily formed into shaped structures, such as snowballs, snowmen and the like. The present invention is not primarily concerned with this type of snow, for with easily molded snow, the present invention does not materially improve on the ability of such snow to be molded into a desired shape.

However, other large geographical areas have colder and drier winter climates where, when snow falls, it is usually dry, cold (well below freezing), powdery and free running. This is the type of snow with which the present invention is primarily concerned. This snow, when pressed together in the manner that one would press together wet, slushy or damp snow as described above, does not easily form into a shaped structure. In fact, this type of snow is often so un-moldable that forming a shaped structure is in practice impossible. In such cold climates, it is only on especially mild days, usually in spring, that the snow is in condition for shaped structures, including snowballs and snowmen, to be made with it.

B. DESCRIPTION AND DEFICIENCIES OF THE TWO COMMON 'COLD SNOW ENVIRONMENT' SNOW SHELTERS: IGLOOS AND QUINZHEES

Igloos are dome-shaped snow structures constructed in environments of wind-driven hard packed snow. This snow is cut into blocks and stacked to form a dome shaped shelter. The igloo snow shelter method is limited to tundra or vast open areas where winds blow sufficiently to pack the cold dry snow deeply and over broad areas. The igloo snow shelter method is also limited to those who have the special knowledge necessary to cut and stack the blocks in a very specific pattern.

Quinzhees are constructed by heaping loose snow into a pile, which is hollowed out to provide a chamber. Quinzhees are often used where snow conditions do not permit the cutting of blocks for an igloo. The construction of a quinzhee involves the use of very large volumes of snow because of the material's low angle of repose. That is, a quinzhee pile is a low heap of loose, free running material. It is the kind of shape that one would achieve by pouring sugar, salt or powder in a loose heap. Indeed, some snow textures are referred to as "sugar" or "powder", particularly in downhill skiing environments. The snow pile, once made, must rest for some time for the snow crystals to bond, hardening the pile to the point that it can be hollowed out. This bonding is a characteristic property of snow that is unlike most other free running, powdery materials. The rest period can be short or very long (often up to several hours) depending on snow conditions. A quinzhee once 'set-up' after the relatively long waiting period, is hardened throughout the structure so that the snow to be removed to provide a chamber is also hardened, and therefore hard to remove. Quinzhees, due to their irregular shapes, and the necessity of waiting for the snow to harden (a time span not easily determined), are susceptible to collapse.

C. INSULATIVE PROPERTIES OF SNOW

Snow is known to be an excellent thermal insulator. While snow itself is cold, a body of snow will sustain a large thermal gradient. In a test of a shelter constructed according to the present invention, conducted in EMBARRASS, Minn. in February 1997, the external temperature reached −59° Farenheit. Inside the shelter, it was approximately +150° Farenheit, a difference of approximately 74° Farenheit warmer than the outside air. It is to be understood that snow is an abundant and highly insulating building material and that many thousands of people use snow structures as a significant if not critical part of their winter activities.

D. THE CURRENT MARKET

Igloos or snow shelters may be perceived by those unfamiliar with their use as being from the distant past, as being non-progressive or archaic. While it is true that great strides have been made in building technology, it is also a fact that many thousands of people and many institutions such as the Boy Scouts recreationally winter camp, and those in many vocations such as hunters, outfitters, search and rescue personnel, park patrols and the like currently use snow shelters for survival.

SUMMARY

The present invention is concerned with a method of relatively quickly, and especially in comparison with traditional methods, making a snow structure regardless of the existing snow conditions, even in free running very cold, (that is below freezing), powder snow.

According to the present invention there is provided a method of constructing a snow dome comprising:

(a) forming an annular skirt;

(b) filling the skirt with snow;

(c) packing a layer of the snow adjacent the inside the skirt;

(d) extending the skirt to a higher level;

(e) filling the extended skirt with snow; and (f) repeating steps (c), (d), and (e) until a desired dome height is reached.

With this method, a dome may be constructed using less material than for a quinzhee. If the snow is packed around the inside of the skirt during production, the dome may be hollowed out immediately after completion, with no rest period required. Also, since no waiting time is required, the interior snow to be hollowed out is still soft, and easy to remove.

A dome constucted according to the present invention will generally possesses the strength, roominess, arch shape strength, and aesthetically pleasing attributes of the igloo shape, and the low-snow condition specific and low skill requirement of the quinzhee. The present invention eliminates the high-skill and high snow condition specific requirements of the igloo and the long waiting period, hardened center, and danger of collapse of the quinzhee.

The skirt is preferably made from a set of panels of flaccid material, most preferably a light weight textile fabric. These panels may be configured with each having a base edge, a top and two side edges converging from the base edge to the top. The panels are then fastened together side by side to a first level spaced slightly above their base edges to form the skirt.

The skirt is subsequently extended by fastening the panels together side to side to a higher level.

Alternatively, the panels may be assembled into a sequential set of annular skirts, one above the other.

Building the dome in this way allows the production of a regular, compact configuration. The dome preferably has a hemispherical configuration, like that of a conventional igloo. As the snow is filled step by step into the envelope, it may be compacted as desired or as required by the snow conditions.

Once constructed, the dome may be hollowed out to provide the desired shelter.

In preferred embodiments, a series of depth probes are driven radially into the finished dome, so that as the dome is hollowed out, the probes act as wall thickness gauges.

The method may also include the installation of a door assembly.

These and other features are included in the embodiments of the invention described in the following.

BRIEF DESCRIPTION OF THE DRAWINGS

In the accompanying drawings which illustrate exemplary embodiments of the present invention.

DETAILED DESCRIPTION

Figure 1:
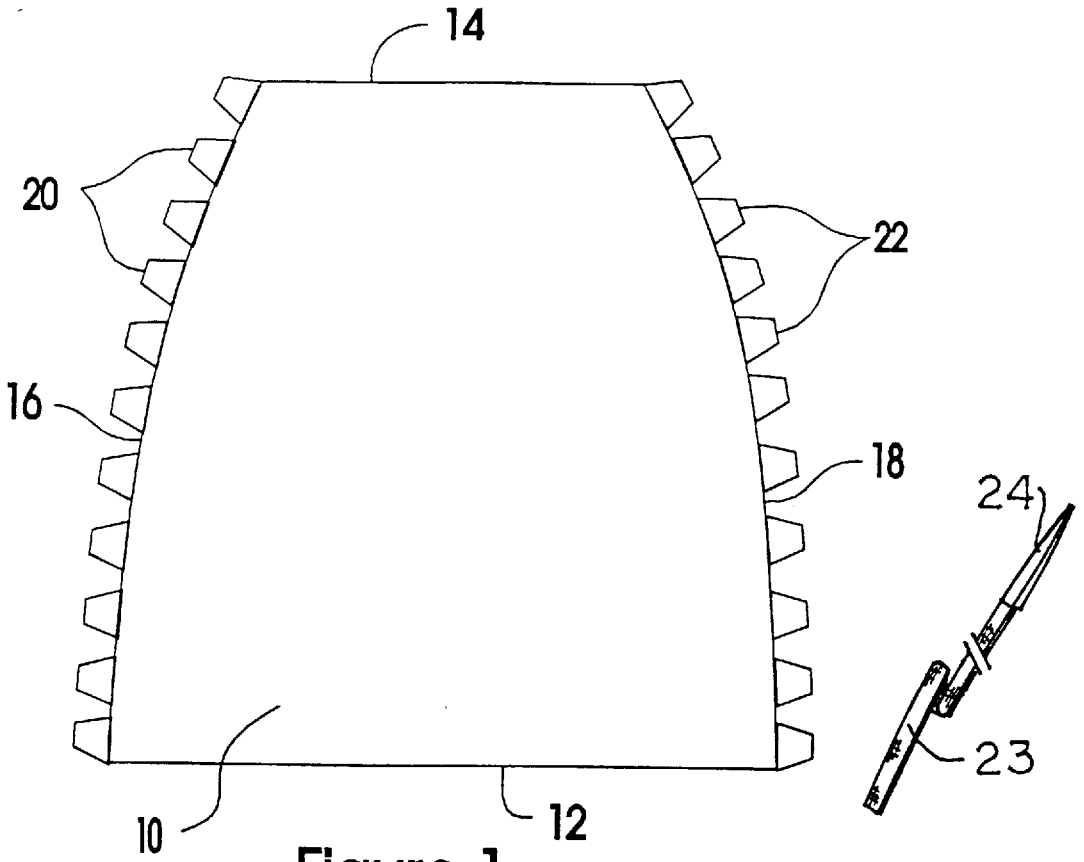
FIG. 1 illustrates two components of a set of apparatus that may be used in performing the method of the present invention.

Referring to the accompanying drawings, FIG. 1 illustrates the components of a basic set of apparatus for forming a dome. This includes a panel 10 of textile fabric material. The panel has a straight base edge 12, a straight top edge 14 parallel to the base edge and somewhat shorter than the base edge and two convexly contoured side edges 16 and 18 that converge upwardly from the base edge to the top edge.

Side edge 16 carries a series of fastener loops 20 spaced along the edge. Similarly, side 18 carries a series of fastener loops 22 that are spaced along that edge. The fastener loops interleave with those of adjacent panels. The interleaved loops are connected by a webbing lace 23 fixed to the end of a stiff needle 24. The needle is used to thread the webbing through the loops so that two panels may be arranged side by side and connected edge to edge. As will be appreciated, because of the convergent, convex side edges, the resultant assembly of coupled panels will have a contoured configuration, convex on one side and concave on the other.

Figure 2:
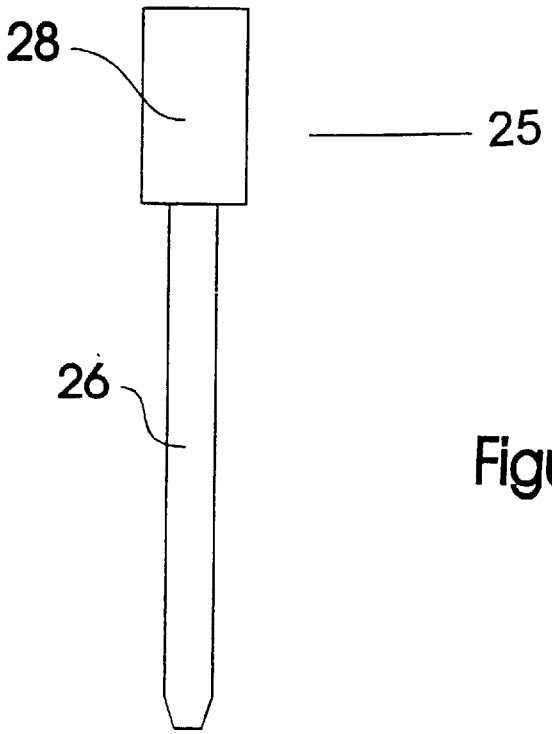
FIG. 2 is an elevation of a depth gauge probe.

FIG. 2 illustrates a depth probe 25 that may be used in the hollowing out of a dome. The probe has a shank 26 and an enlarged handle 28 on one end.

In the complete apparatus of this illustrative embodiment, there are eight panels 10, eight laces 23 and twelve probes 25, all of the same length.

Figure 3:
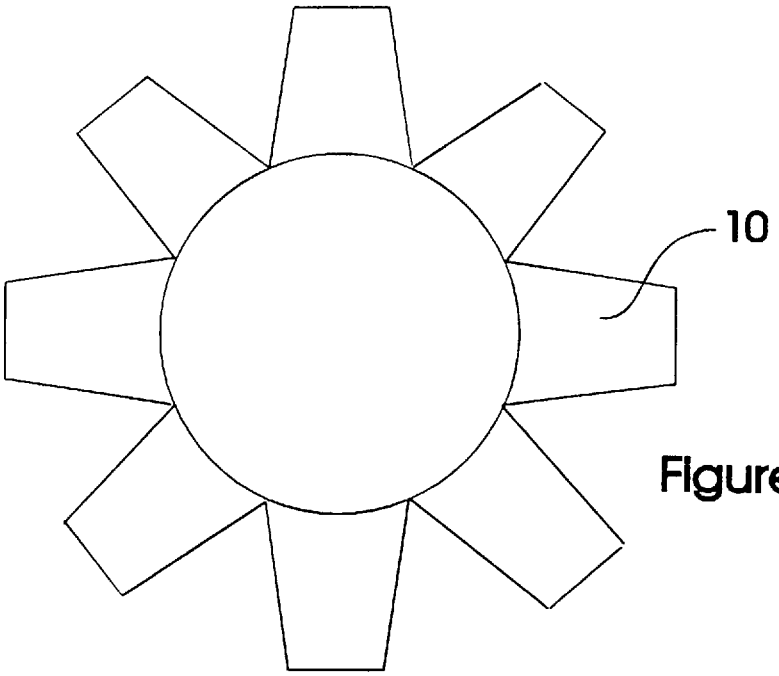
FIG. 3 is a plan view of the panels assembled in a first stage of dome construction.
Figure 4:
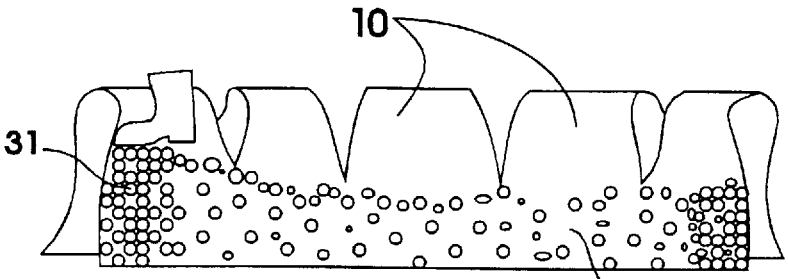
FIGS. 4 through 15 illustrate the successive steps in constructing the snow shelter.

In use of the basic apparatus, the panels 10 are connected side by side adjacent their bases to provide an annular array of panels such as that illustrated in FIG. 3. The panels are connected to a sufficient distance above their base edges to provide a short skirt as illustrated in FIG. 4. To ensure the circularity of the array, a probe or pin may be driven into the surface on which the dome is being constructed and a line connected to that and used as a compass to swing around the centre pin and insure a substantially uniform distance from the centre to each of the panels.

Once the panels have been connected as illustrated in FIGS. 3 and 4, the area encompassed by the panels is filled with snow 30. The edge snow 31 adjacent the panels is preferably compacted at this time. This can be done by hand, foot or shovel. It is preferred that the area compacted is the area adjacent the panels that will remain once the dome is hollowed out to make the snow shelter.

Figure 5:
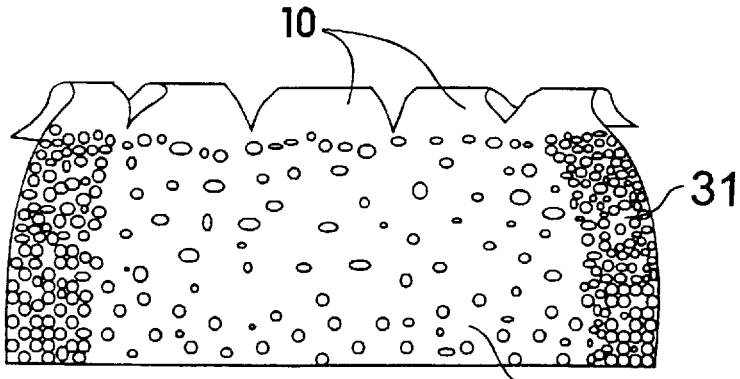
Figure 6:
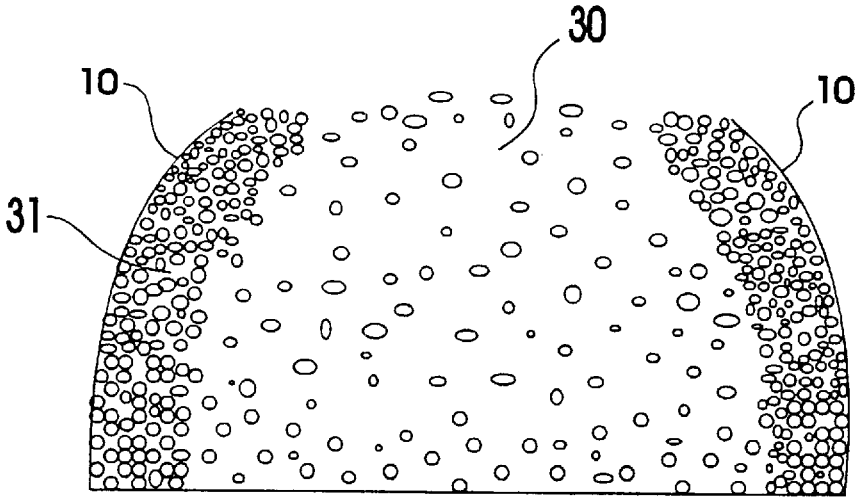
Figure 7:
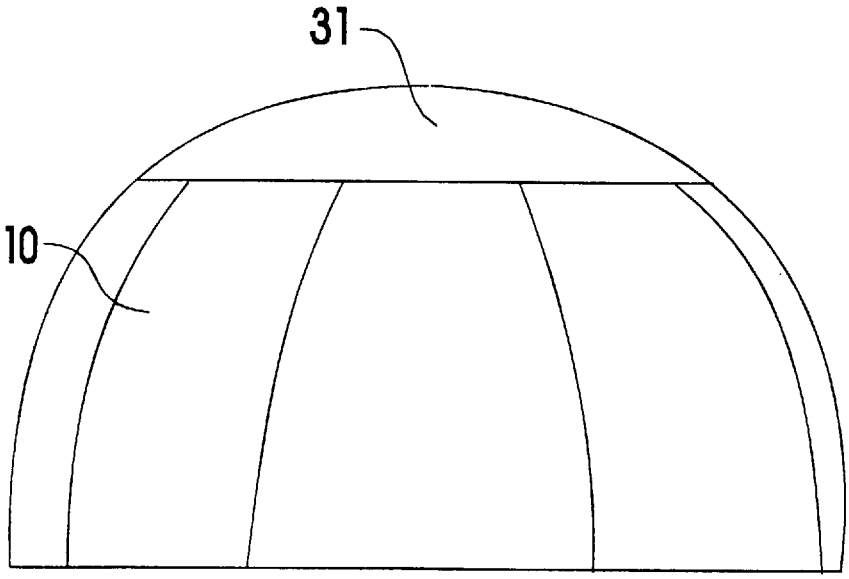
Figure 8:
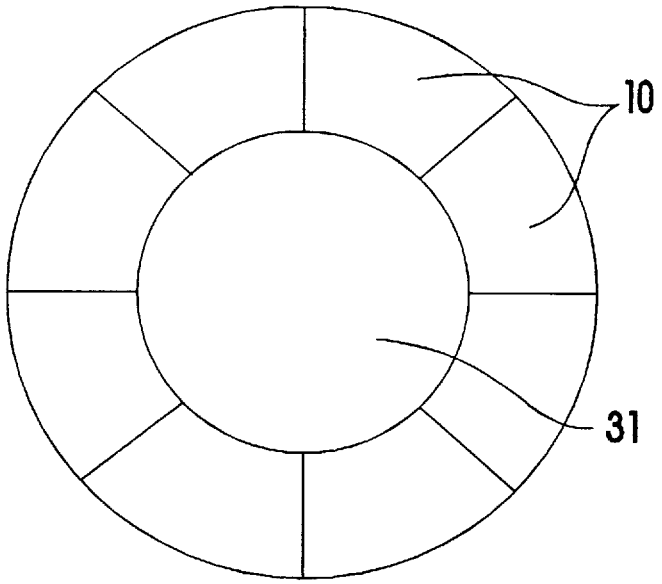

Once the initial skirt has been filled with snow and compacted as desired, the edges of the adjacent panels are connected to a higher level and additional snow is added to the volume encompassed by the connected panels. After compaction of the snow adjacent the panels, the panels are again connected to a higher level and additional snow is added, as illustrated in FIGS. 4, 5, and 6. Once the configuration of FIG. 6 has been reached, the top of the dome is completed by adding additional snow, packing the added snow and smoothing it to the desired shape, in the central area circumscribed by the top edges of the panels 10. This completes the dome as illustrated in FIGS. 7 and 8.

Figure 9:
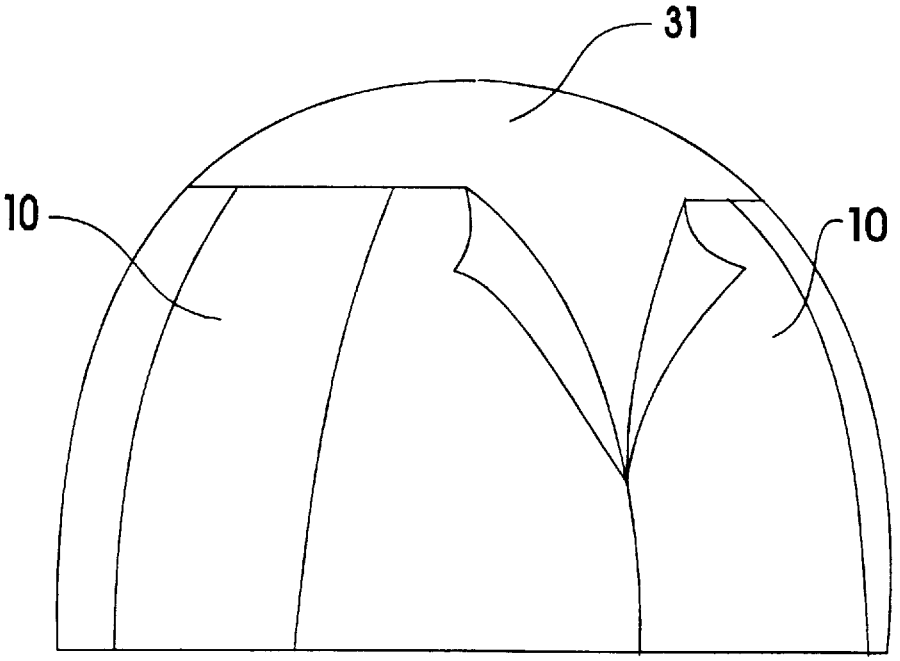
Figure 10:
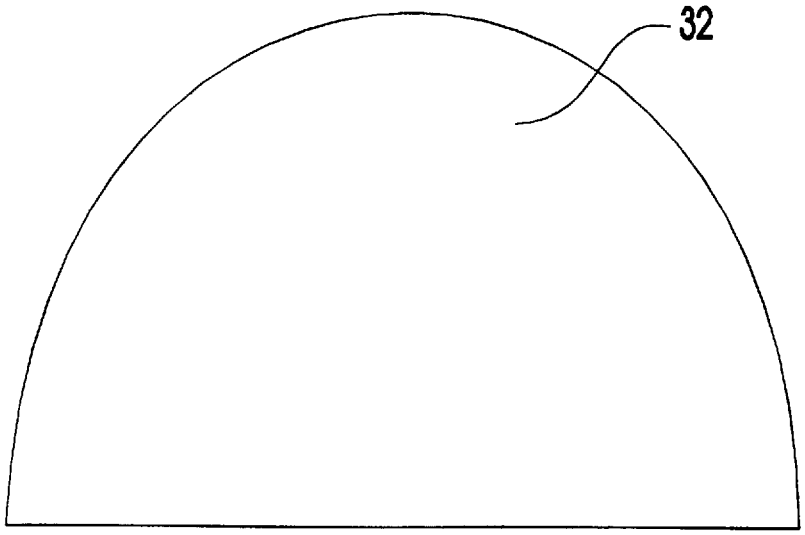
Figure 11:
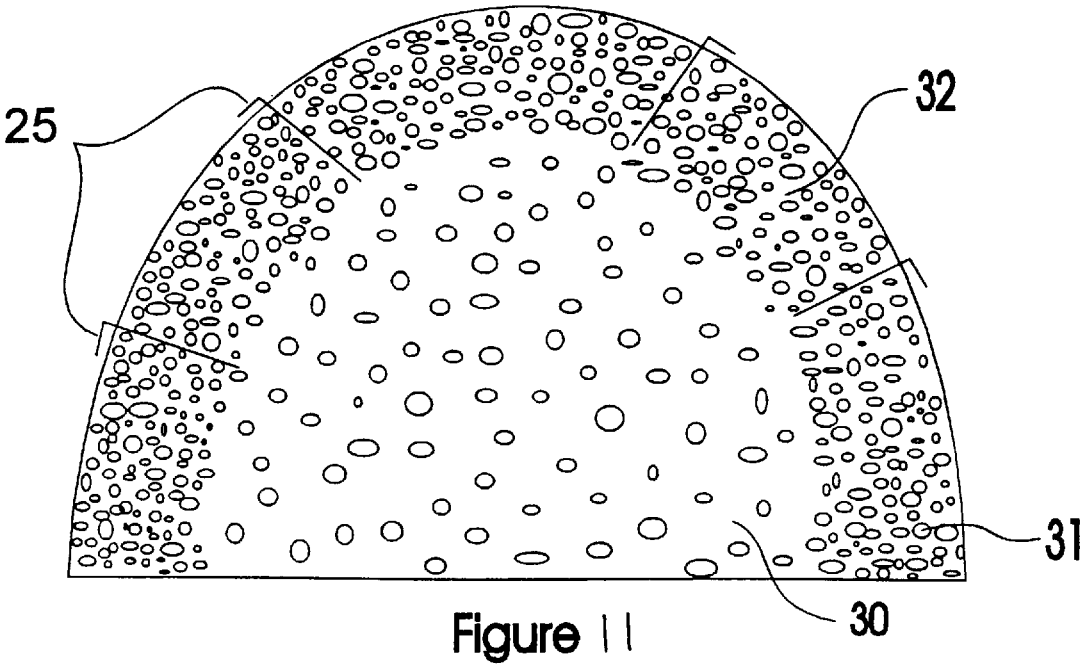
Figure 12:
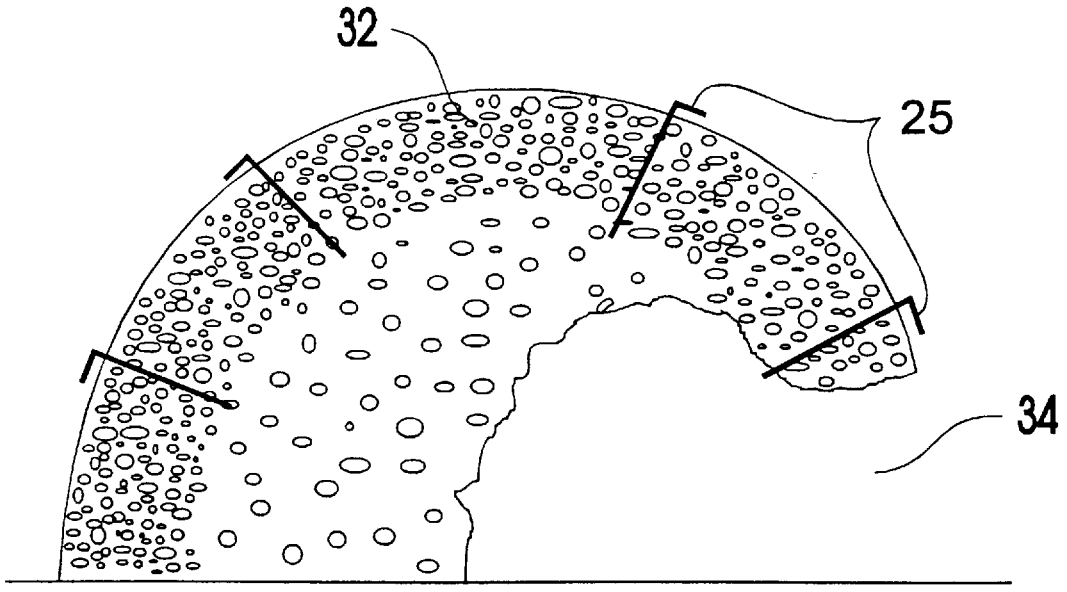
Figure 13:
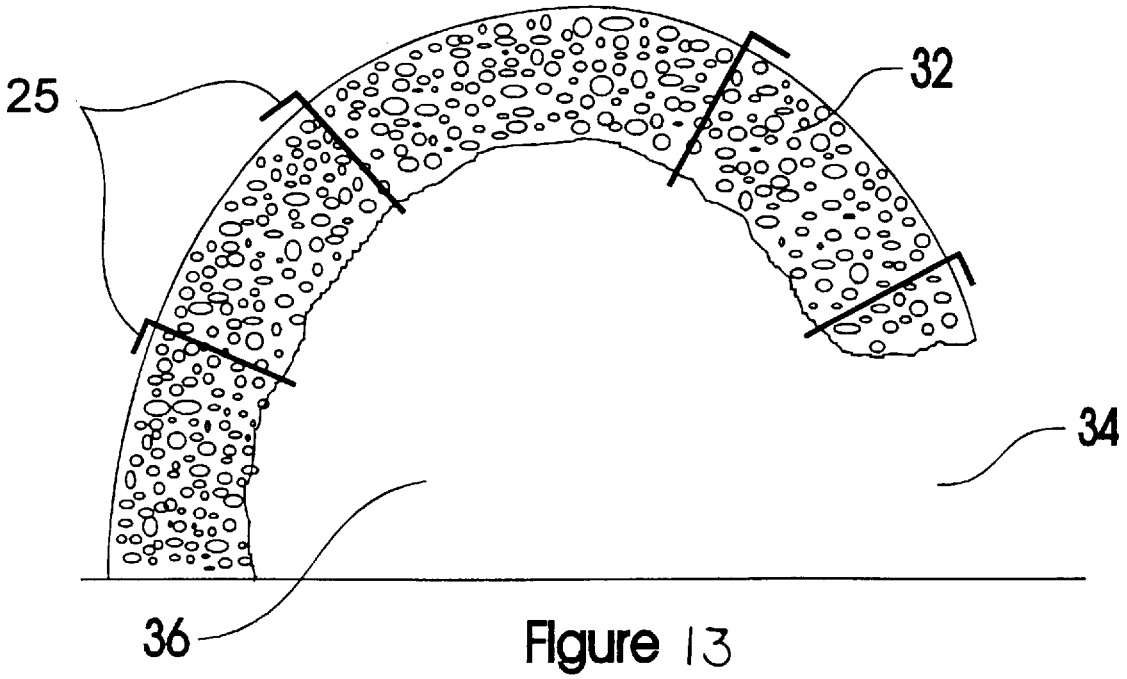
Figure 14:
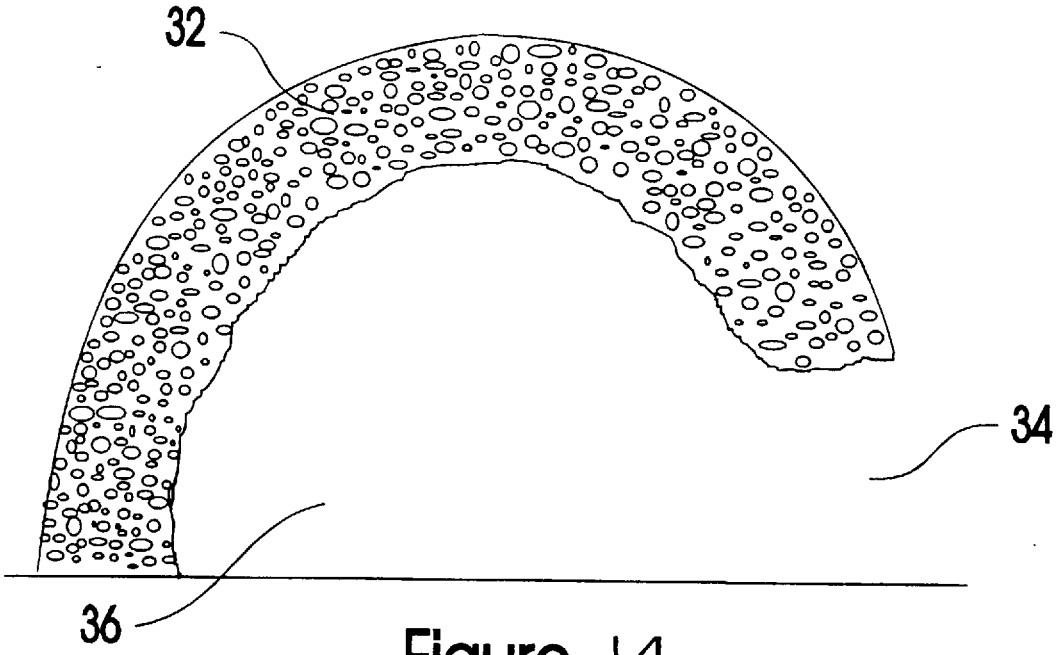
Figure 15:
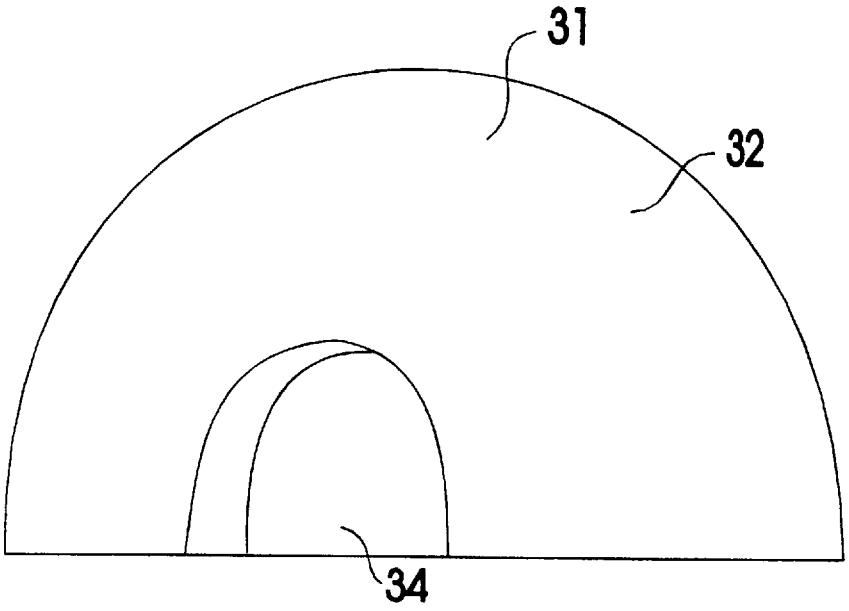

At this time, the fabric panels 10 are removed from the dome, as illustrated in FIG. 9 leaving a unitary snow hemisphere 32 as shown in FIG. 10. The depth pins or probes 25 are inserted into the dome at spaced positions as shown in FIG. 11. An entrance way 34 is then formed in the dome and the centre of the dome is hollowed out to the ends of the probes as illustrated in FIGS. 12 and 13. This leaves a unitary dome of packed snow 32 with a central cavity 36 and an entrance way 34. This serves as the desired snow shelter, having the general configuration of an igloo but manufactured from loose snow rather than stacked snow blocks.

Figure 16:
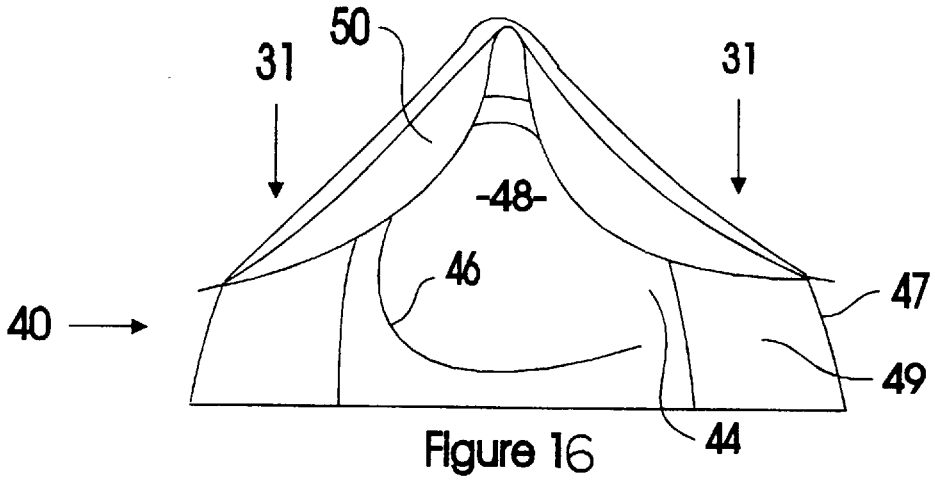
FIG. 16, 17, 18 and 19 are front views showing a door being assembled.
Figure 17:
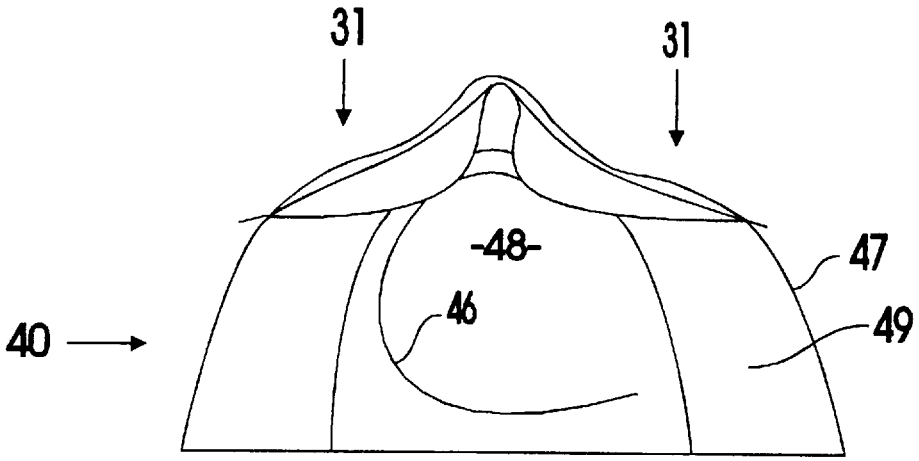
Figure 18:
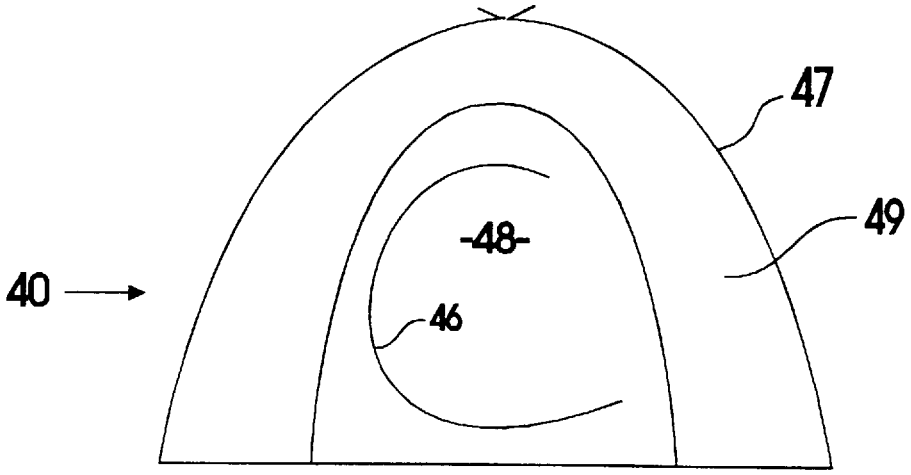
Figure 19:
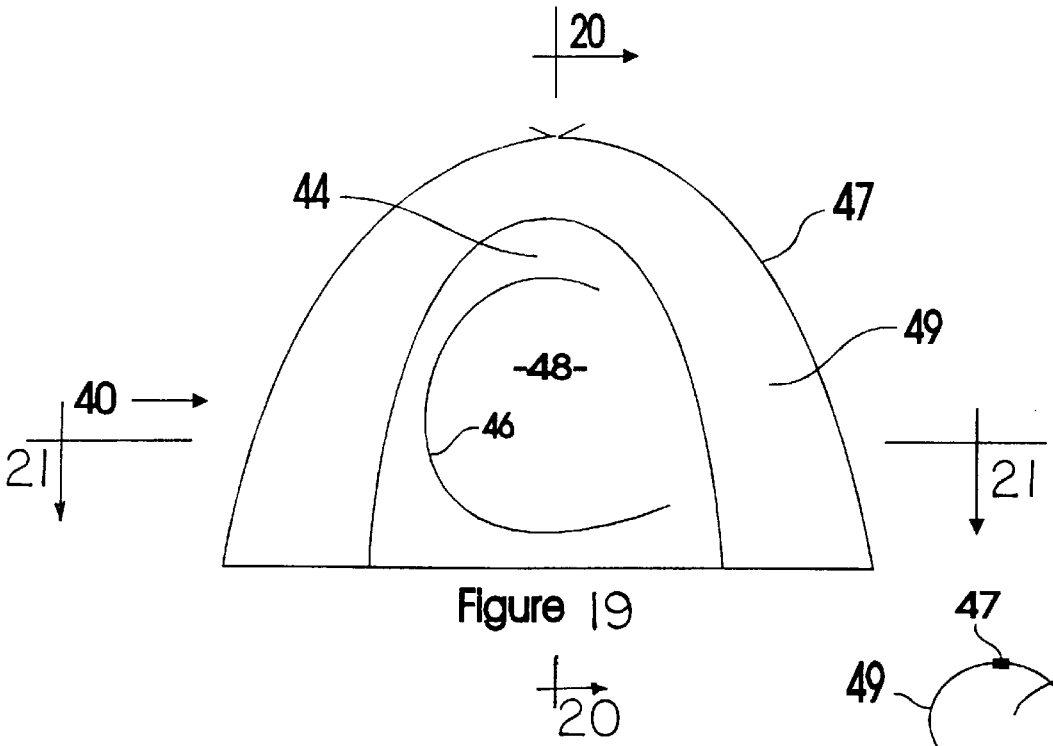
Figure 20:
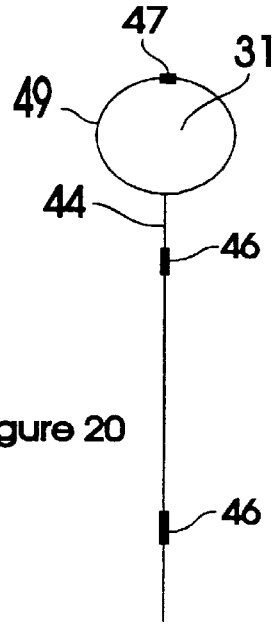
FIG. 20 is a view along line 20—20 of FIG. 19.
Figure 21:
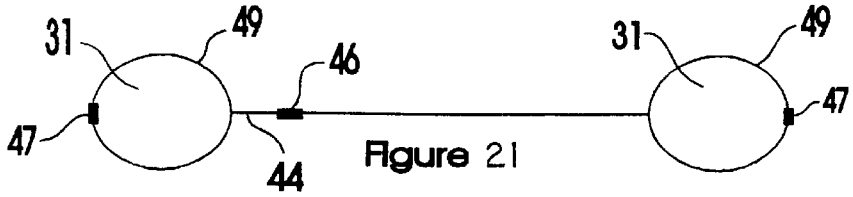
FIG. 21 is a view along line 21—21 of FIG. 19.
Figure 22:
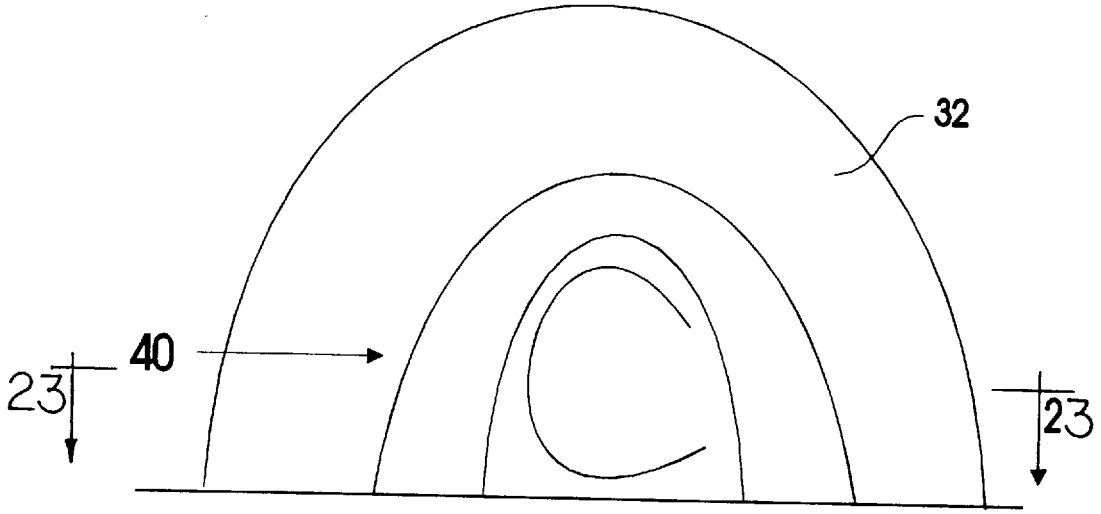
FIG. 22 is a front elevation of a shelter with the door assembly installed.
Figure 23:
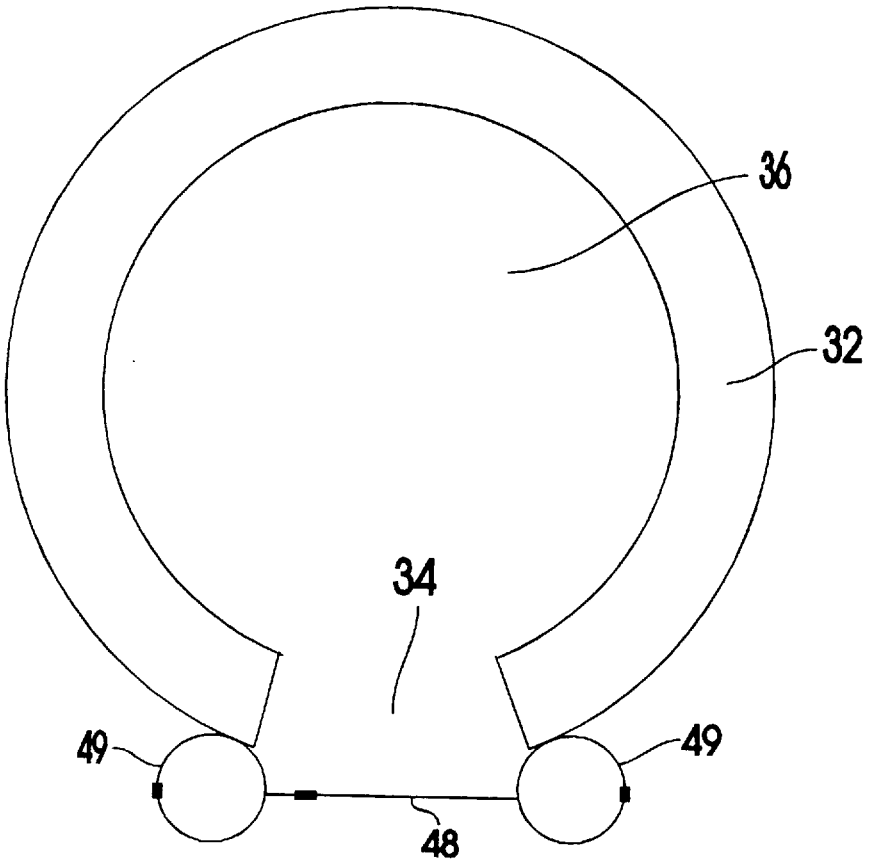
FIG. 23 is a cross section along line 23—23 of FIG. 22.

A door 40 that may be used with the shelter is illustrated in FIGS. 16 through 21. The door includes a fabric door panel 44 with an inverted U-shape along the sides and top. An arcuate zipper 46 around a centre section of the panel defines an openable door 48. A door frame 49 extends along the top and sides of the door panel. The frame consists of two inverted, U-shaped panels of textile fabric 50 fastened around the top and sides of the door panel 44. The outer edges of the fabric panels are joined by two zippers 47 that close from the bottom up. To set up the door, the zippers 47 are sequentially closed to form a tube that is filled and packed with snow 31 to create the tubular frame 49 as illustrated in FIGS. 16, 17 and 18. Once the dome has been completed, the door is leaned against the opening 34 as illustrated in FIGS. 22 and 23.

Figure 24:
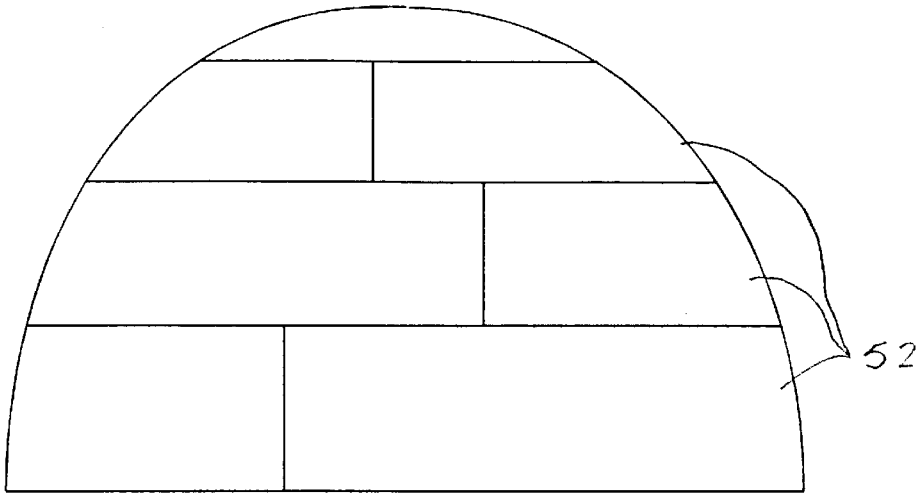
FIG. 24 is a side view of a dome made using an alternative panel embodiment.
Figure 25:
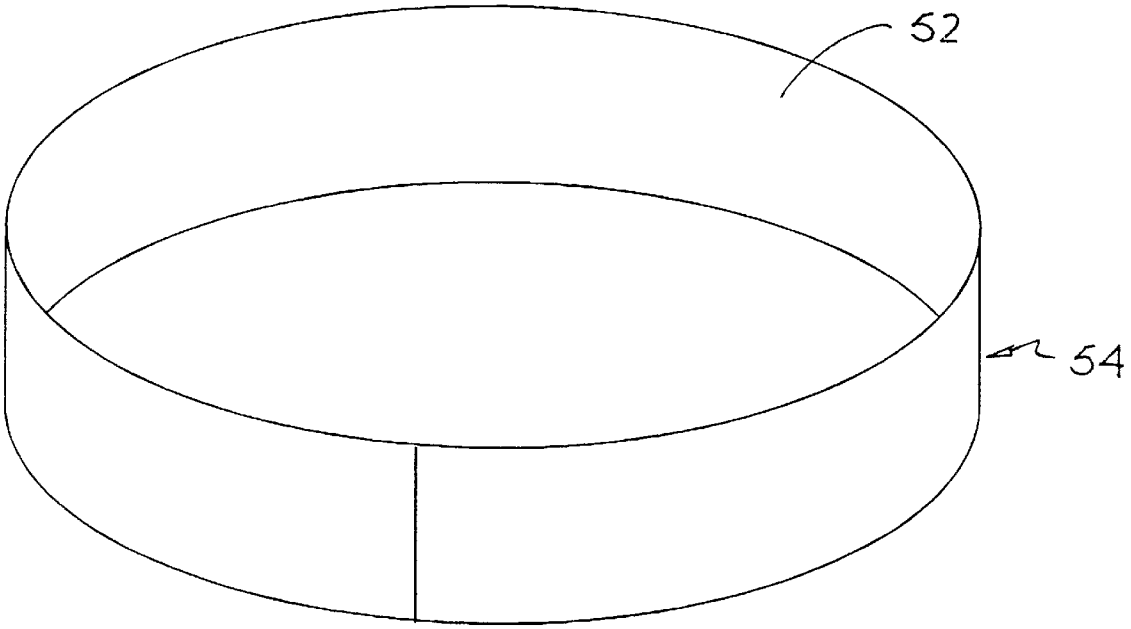
FIG. 25 is an isometric view of a base skirt of the embodiment of FIG. 24.

An alternative embodiment of the invention is illustrated in FIGS. 24 and 25. In this embodiment, each panel 52 is fastened end to end to form an annular band 54, with sequential bands being added to extend the base skirt as the dome is built up. In other embodiments, each band may be formed of plural panels, connected end to end. In a other embodiments the set of bands may consists of one or two bands only.

Figure 26:
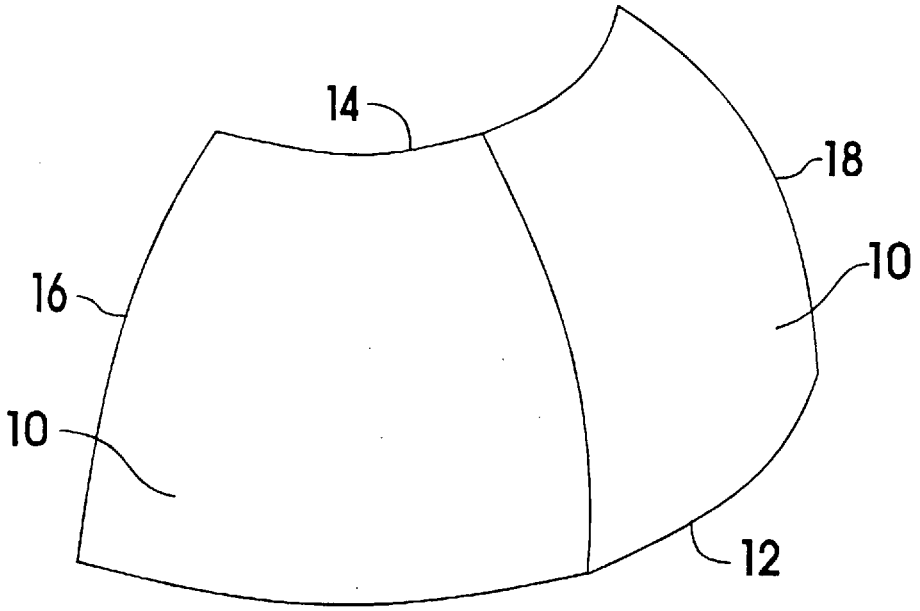
FIG. 26 illustrates a panel embodiment with two panel sections fastened together.

FIG. 26 illustrates another embodiment of the panel, consisting of two permanently joined panels 10 contoured by the permanent seam between their adjacent side edges.

Figure 27:
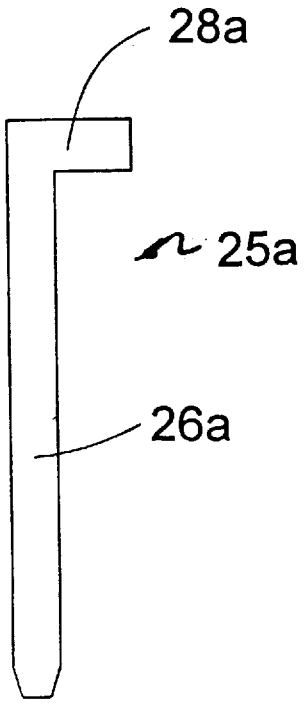
FIGS. 27 and 28 are elevations of respective embodiments of depth gauge probe.

FIG. 27 illustrates an alternative a depth probe 25*a* with a shank 26*a* and a bent handle 28*a* on one end.

Figure 28:
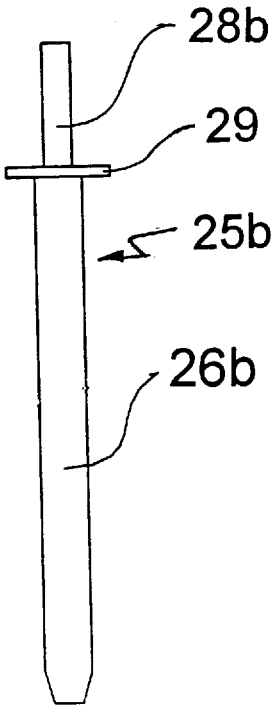

FIG. 28 illustrates an alternative a depth probe 25*b* with a shank 26*b,* a handle 28*b* on one end and a flange 29 between the shank and the handle.

As will be appreciated from the foregoing, modifications in the method and the apparatus are possible without departing from the scope of the present invention. Fasteners other than zippers may be used to close the door panel. The invention is to be construed as limited solely by the scope of the appended claims.

I claim:

1. A method of constructing a snow dome comprising:

(a) forming an annular skirt of flexible material;

(b) filling the skirt with snow;

(c) extending the skirt to a higher level;

(d) filling the extended skirt with snow; and (e) repeating steps (c) and (d) until a desired dome height is reached.

2. A method according to claim 1 comprising:

(a) providing a plurality of panels, or a plurality of sets of permanently joined panels, of flexible material, each with a base edge, a top and two side edges converging from the base edge to the top;

(b) forming the skirt by fastening the panels together side by side to a first level spaced slightly above the base edges thereof'; and (c) subsequently extending the skirt by fastening the panels together side to side to a higher level.

3. A method according to claim 1 comprising:

(a) providing a plurality of panels of flexible material;

(b) forming the skirt by fastening at least one of the panels together end to end; and (c) extending the skirt by fastening others of the panels together end to end and onto the top of the existing skirt.

4. A method of constructing a snow shelter which comprises constructing a snow dome according to the method of claim 1 and subsequently hollowing out the dome.

5. A method according to claim 4 wherein hollowing out of the dome comprises the steps of inserting pins into the dome, from the outside towards the centre thereof, and hollowing out the interior of the dome to the ends of the pins.

6. A method according to claim 1 including the step of compacting the snow after each filling step.

7. A method according to claim 6 wherein the step of packing the snow comprises compacting an of snow adjacent the skirt.

8. A method according to claim 1 including providing a door assembly having self-supporting frame means, a panel supported by the frame means and an openable section within the panel, placing the door assembly against the opening of a finished dome.

* * * * *